US006412147B1

(12) United States Patent
Chen

(10) Patent No.: US 6,412,147 B1
(45) Date of Patent: Jul. 2, 2002

(54) FASTENING DEVICE FOR FOOTWARE

(76) Inventor: Min-Sung Chen, 11 F-2 No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/768,581

(22) Filed: Jan. 25, 2001

(51) Int. Cl.[7] ..... A43B 5/00; A43C 11/14

(52) U.S. Cl. ..... 24/68 SK; 24/69 SK; 24/70 SK; 24/71 SK; 36/115; 280/11.12

(58) Field of Search ..... 24/68 SK, 70 SK, 24/69 SK; 12/142 P; 36/115; 280/7.13, 11.12

(56) References Cited

U.S. PATENT DOCUMENTS 2,273,541 A * 2/1942 Summerhayes ..... 280/11.12
4,114,295 A * 9/1978 Schaefer ..... 36/115
4,777,741 A * 10/1988 James ..... 36/115
5,526,555 A * 6/1996 Battistella et al. ..... 24/68 SK
5,575,045 A * 11/1996 Chu ..... 24/68 SK
5,641,169 A * 6/1997 Bekessy ..... 280/11.12
5,909,850 A * 6/1999 Cavasin et al. ..... 24/71 SK
6,082,744 A * 7/2000 Allinger et al. ..... 280/11.12

* cited by examiner

*Primary Examiner*—Victor Sakran
(74) *Attorney, Agent, or Firm*—Charles E. Baxley

(57) ABSTRACT

A fastening device for footwear includes a base on footwear and a first hook extends from a top surface of the base. A locking member is pivotally connected the base and a recess is defined in an end of the locking member. The first hook extends through a notch in an underside of the locking member. Two slots are defined through the underside of the locking member. A plate is movably received in the recess in the locking member with two second hooks thereof movably received in the two slots. A third hook extends from the underside of the plate so as to be engaged with the first hook. A biasing member extends from an end of the plate so as to contact against an inner surface of the recess.

5 Claims, 3 Drawing Sheets

FASTENING DEVICE FOR FOOTWARE

FIELD OF THE INVENTION

The present invention relates to a fastening device for skates and the fastening device can be unlocked by simply pushing a plate and locked by pressing the locking member downward.

BACKGROUND OF THE INVENTION

A conventional fastening device for skates generally includes a base fixedly on the skates and a locking member pivotally connected to the base. A toothed belt is connected to the locking member and can be inserted into a securing means on the skates. The locking member is locked with the base to tighten the toothed belt and when the user wants to loosen the belt, he/she unlocks the locking member and pulls the toothed from the securing means. A plate is connected to the locking member and controls the locking status of the locking member so that when the users unlock the toothed belt, the plate is to be operated such as by pushing or lifting it. The steps of processes for tightening or loosening the toothed belt are deemed to be complicated or inconvenient for the users.

The present invention intends to provide a fastening device that requires a simple action to lock or unlock the device.

SUMMARY OF THE INVENTION

In accordance with one aspect of the present invention, there is provided a fastening device for footwear and comprising a base having two lugs and a first hook extending from a top surface of the base. A locking member is pivotally connected between the two lugs and a recess is defined in an end of the locking member. A notch is defined in an underside of the locking member so that the first hook extends through the notch. Two slots are defined through the underside of the locking member and the notch is located between the two slots. A plate is movably received in the recess in the locking member and two second hooks extend from an underside of the plate. The two second hooks are movably received in the two slots in the locking member and a third hook extends from the underside of the plate so as to be engaged with the first hook. A biasing member extends from an end of the plate so as to contact against an inner surface of the recess.

The primary object of the present invention is to provide a fastening device that is locked or unlocked by only one action.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figures 1, 8, 9:
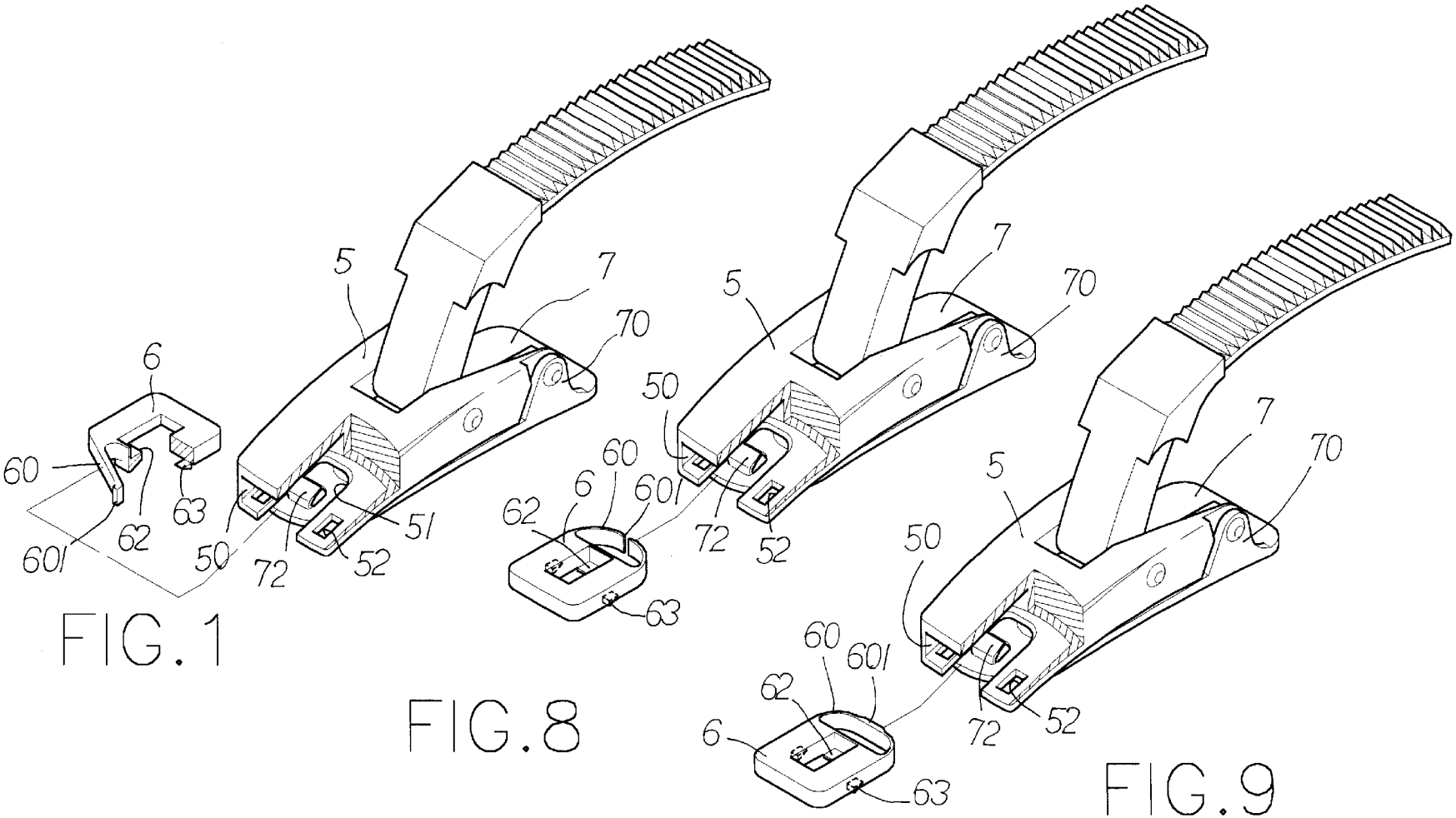
FIG. 1 is an exploded view to show a fastening device of the present invention.
FIG. 8 is an exploded view to show another embodiment of the biasing members of the locking member of the present invention.
FIG. 9 is an exploded view to show yet another embodiment of the biasing members of the locking member of the present invention.
Figure 2:
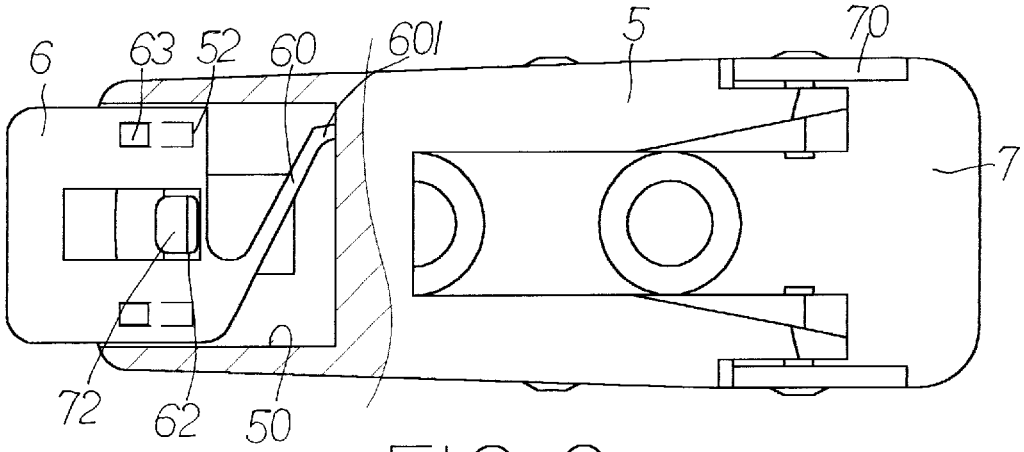
FIG. 2 is a top plan view to show the plate is received in the recess of the locking member of the fastening device of the present invention.

Referring to FIGS. 1 and 2, the fastening device for footwear of the present invention comprises a base 7 having two lugs 70 and fixedly connected on footwear. A first hook 72 extends from a top surface of the base 7. A locking member 5 is pivotally connected between the two lugs 70 and a recess 50 is defined in an end of the locking member 5. A toothed belt is connected to the locking member 5 and a notch 51 is defined in an underside of the locking member 5 so that the first hook 72 extends through the notch 51 and is located in the recess 50. Two slots 52 are defined through the underside of the locking member 5 and the notch 51 is located between the two slots 52.

A plate 6 is movably received in the recess 50 in the locking member 5 and two second hooks 63 extend from an underside of the plate 6. The two second hooks 63 are movably received in the two slots 52 in the locking member 5 so as to prevent the locking member 5 from being disengaged from the plate 6. Further referring to FIG. 4, a third hook 62 extends from the underside of the plate 6 and the third hook 62 has an inclined surface 621 which faces a distal end of the first hook 72 so that when pushing the locking member 5 together with the plate 6 toward the base 7, the inclined surface 621 slips over the first hook 72 and then engages with the first hook 72. A biasing member 60 extends inclinedly from an end of the plate 6 and a tip 601 extends from a distal end of the biasing member 60 so that the biasing member 60 contacts against an inner surface of the recess 50 and have a bouncing force when the biasing member is pushed as shown in FIG. 3.

Figure 3:
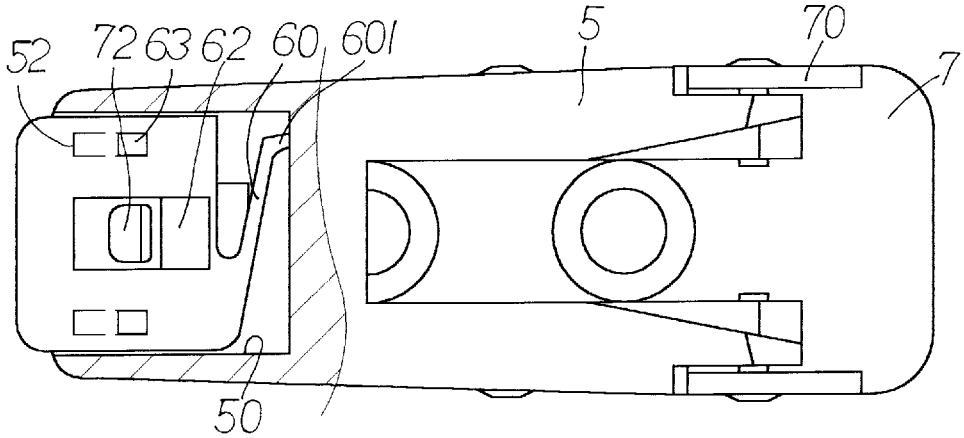
FIG. 3 is a top plan view to show the plate in the recess of the locking member is pushed.
Figure 4:
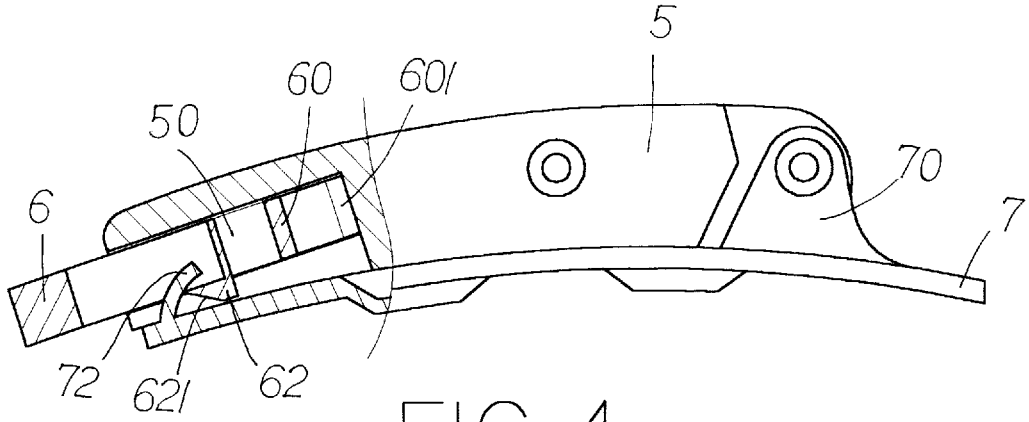
FIG. 4 is a side cross sectional view to show a hook of the plate is engaged with a hook on the base.
Figure 5:
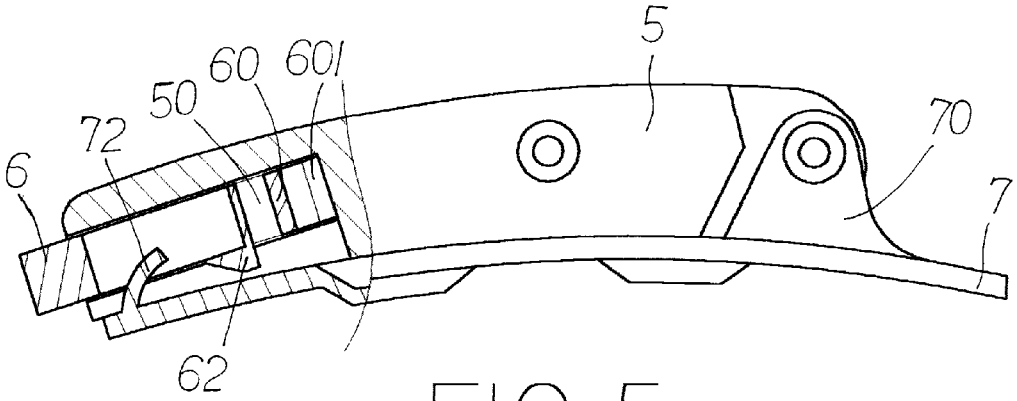
FIG. 5 is a side cross sectional view to show the plate is pushed and the two respective hooks are separated.
Figure 6:
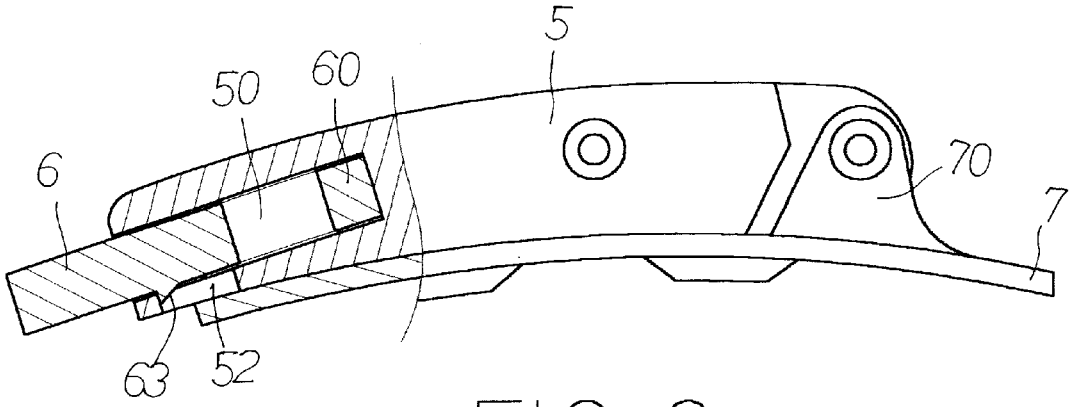
FIG. 6 is a side cross sectional view to show the plate is retained in the two slots in the locking member by engaging hooks with the slots.
Figure 7:
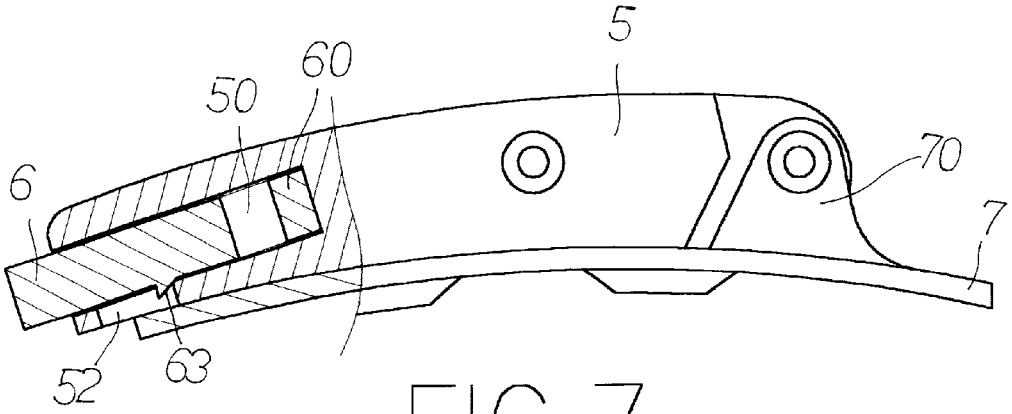
FIG. 7 is a side cross sectional view to show the plate is pushed and the hooks of the locking member is moved in the slots.

As shown in FIGS. 3, 5 and 7, when unlocking the fastening device, the plate 6 is pushed and the third hook 62 is moved away from the first hook 72, and the second hooks 63 are moved in the slots 52. The locking member 5 is able to be pivoted upward the loosen the toothed belt. Referring to FIGS. 4 and 6, when locking the locking member 5, the user simply pushes the locking member 5 downward to slip the inclined surface 621 over the first hook 72 and then engages with the first hook 72. The plate 6 is back to its original position by the biasing force of the biasing member 60.

FIG. 8 shows that the biasing member 60 includes two curved plates extending from two sides of the end of the plate 6 and toward each other. FIG. 9 shows that the biasing member 60 is a bouncing ring extending from the end of the plate 6 and the tip 601 extends from the bouncing ring.

The biasing member 60 can be easily made integrally with the plate 6 and this simplifies the assembling processes of the fastening device.

While we have shown and described various embodiments in accordance with the present invention, it should be clear to those skilled in the art that further embodiments may be made without departing from the scope and spirit of the present invention.

What is claimed is:

1. A fastening device for footwear, comprising:

a base having two lugs and a first hook extending from a top surface of said base;

a locking member pivotally connected between said two lugs and a recess defined in an end of said locking member, a notch defined in an underside of said locking member and said first hook extending through said notch, two slots defined through said underside of said locking member and said notch located between said two slots, and a plate movably received in said recess in said locking member and two second hooks extending from an underside of said plate, said two second hooks movably received in said two slots in said locking member, a third hook extending from said underside of said plate so as to be engaged with said first hook, a biasing member extending from an end of said plate so as to contact against an inner surface of said recess.

2. The device as claimed in claim 1, wherein said third hook has an inclined surface which faces a distal end of said first hook.

3. The device as claimed in claim 1, wherein said biasing member extends inclinedly from said end of said plate.

4. The device as claimed in claim 1, wherein said biasing member includes two curved plates extending from two sides of said end of said plate.

5. The device as claimed in claim 1, wherein said biasing member is a bouncing ring extending from said end of said plate.

* * * * *